US010221034B2

(12) United States Patent
Johnson et al.

(10) Patent No.: US 10,221,034 B2
(45) Date of Patent: Mar. 5, 2019

(54) MOBILE PROCESSING FRAME, MOBILE PROCESSING SYSTEM, AND METHOD OF PROCESSING

(71) Applicant: TYCO ELECTRONICS CORPORATION, Berwyn, PA (US)

(72) Inventors: Daniel Len Johnson, Winston-Salem, NC (US); Darden Ramsey Jones, Kernersville, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 674 days.

(21) Appl. No.: 14/638,403

(22) Filed: Mar. 4, 2015

(65) Prior Publication Data

US 2016/0257523 A1 Sep. 8, 2016

(51) Int. Cl.

| | |
|---|---|
| ***B65H 49/28*** | (2006.01) |
| ***B65H 49/34*** | (2006.01) |
| ***B65H 19/12*** | (2006.01) |

(52) U.S. Cl.

CPC ..... *B65H 49/28* (2013.01); *B65H 19/12* (2013.01); *B65H 49/34* (2013.01); *B65H 2405/422* (2013.01); *B65H 2701/37* (2013.01)

(58) Field of Classification Search

CPC ..... B65H 49/28; B65H 19/12; B65H 49/34

(Continued)

(56) References Cited

U.S. PATENT DOCUMENTS 3,570,731 A * 3/1971 Waltz ..... A47F 7/175 225/38
4,736,899 A * 4/1988 Murasaki ..... B65H 18/02 242/531

(Continued)

FOREIGN PATENT DOCUMENTS

| | | |
|---|---|---|
| DE | 202 03 489 U1 | 6/2002 |
| EP | 0 229 528 A2 | 7/1987 |
| JP | H05 19258 U | 3/1993 |
| JP | 2011 178539 A | 9/2011 |

OTHER PUBLICATIONS

Vereecke, Design and Validation of an In-plant Transportation System at an Automotive Supplier, Jun. 2, 2009, pp. 42, 43, figure 4.7.

International Search Report, Intenational Application No. PCT/2016/020324, International Filng Date, Mar. 2, 2016.

*Primary Examiner* — Michael R Mansen
*Assistant Examiner* — Mark K Buse

(57) ABSTRACT

Provided are a mobile processing frame, a mobile processing system, and a method of processing. The mobile processing frame includes a base portion having an electrical receptacle and a pneumatic receptacle positioned thereon, a turntable rotatably coupled to the base portion, a motor secured to the base portion and operably connected to the turntable, a mobile support secured to the base portion, opposite the turntable, and a locking member configured to selectively restrict movement of the mobile support. The turntable is configured to receive a processing material thereon, and feed the processing material therefrom. The processing system includes the mobile processing frame, a control device, and a transport device configured to move the frame. The method includes positioning a processing material on a frame, moving the frame to a processing area, coupling a control device to the frame, and feeding the processing material from the frame to a processing device.

13 Claims, 5 Drawing Sheets

(58) Field of Classification Search
USPC ..... 242/557, 403
See application file for complete search history.

(56) References Cited

U.S. PATENT DOCUMENTS 4,979,692 A 12/1990 Julian
5,123,607 A 6/1992 Jones
5,647,554 A * 7/1997 Ikegami ..... B25J 19/0025 191/12.2 A
5,887,816 A * 3/1999 Jones ..... B21C 47/18 242/420.6
5,934,604 A * 8/1999 Klimek ..... B65H 16/06 242/557
5,941,475 A * 8/1999 Gentry, Jr. ..... B65H 19/30 242/533.8
6,109,561 A * 8/2000 Haines ..... H02G 1/08 242/598.3
6,161,791 A * 12/2000 Gentry, Jr. ..... B65H 19/30 242/533.8
6,273,666 B1 * 8/2001 Barnowski ..... H05K 13/021 269/17
6,470,657 B2 * 10/2002 Huson ..... B65B 67/08 53/390
6,860,496 B2 * 3/2005 Novak ..... B62B 5/049 211/20
7,350,741 B1 * 4/2008 Rosa ..... B65H 75/265 242/403
8,205,819 B2 * 6/2012 Groff ..... B65H 23/042 242/420.6
8,398,013 B2 * 3/2013 Skalleberg ..... B65H 49/24 242/393
8,801,005 B1 * 8/2014 Flickner ..... B62B 3/04 280/35
9,370,969 B2 * 6/2016 Kroening ..... B60B 33/0002
2012/0048988 A1 * 3/2012 Pulver ..... B65H 49/32 242/557
2013/0248638 A1 * 9/2013 Luo ..... E01D 21/00 242/470

* cited by examiner

MOBILE PROCESSING FRAME, MOBILE PROCESSING SYSTEM, AND METHOD OF PROCESSING

FIELD OF THE INVENTION

The present invention is directed toward a mobile processing system and a method of processing. More specifically, the present invention is directed to a mobile spooled dereeler system and a method for dereeling material from a mobile system.

BACKGROUND OF THE INVENTION

During various processing operations, a processing material is provided in coils, spools, or reels, which are wound for distribution. The material is generally mounted on a dispenser, such as a dereeler, which supplies the material during processing. For example, a spool or reel of material is frequently mounted on a pallet, and rotated about an axle to feed the material to a processing machine. In order to provide a continuous or substantially continuous feed of material, large spools or reels of material are typically used.

Currently, dereelers are stationary, with individual spools of material being removably mounted thereto for processing. Often, a forklift or other machinery is required to transport the spools and/or change materials between stationary dereelers. The changing of the materials using forklifts or other machinery includes individual transportation of the material spools, which requires multiple trips from a loading area to each processing area. The multiple trips required to remove one spool of material and replace it with another increase processing risk, increase processing time, and decrease processing efficiency. Additionally, each of the stationary dereelers requires separate control mechanisms, which increases the cost of the processing system.

One method of decreasing down time includes the use of multiple forklifts or other machinery to transport the individual spools. However, using multiple pieces of machinery further increases processing costs as well as the risks associated with transporting the spools of material.

A system and method with improvements in the process and/or the properties of the components formed would be desirable in the art.

SUMMARY OF THE INVENTION

In one exemplary embodiment, a mobile processing system includes a frame, a control device, and a transport device configured to move the frame. The frame includes a base portion, a turntable rotatably coupled to the base portion, a motor secured to the base portion and operably connected to the turntable, and a mobile support secured to the base portion, opposite the turntable.

In another exemplary embodiment, a method of processing includes positioning a processing material on a frame, moving the frame to a processing area, coupling a control device to the frame, and feeding the processing material from the frame to a processing device. The control device controls a feed rate of the processing material.

In another exemplary embodiment, a mobile processing frame includes a base portion having an electrical receptacle and a pneumatic receptacle positioned thereon, a turntable rotatably coupled to the base portion, a motor secured to the base portion and operably connected to the turntable, a mobile support secured to the base portion, opposite the turntable, and a locking member configured to selectively restrict movement of the mobile support. The turntable is configured to receive a processing material thereon, and feed the processing material therefrom.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF EXEMPLARY EMBODIMENTS

Provided are a mobile processing frame, a mobile processing system, and a method of processing. Embodiments of the present disclosure, in comparison to components and methods not using one or more of the features disclosed herein, permit transportation of processing material on a processing frame, provide interchangeable control elements, increase processing efficiency, permit transportation of multiple spools of processing material at one time, decrease processing time, or a combination thereof.

Figure 1:
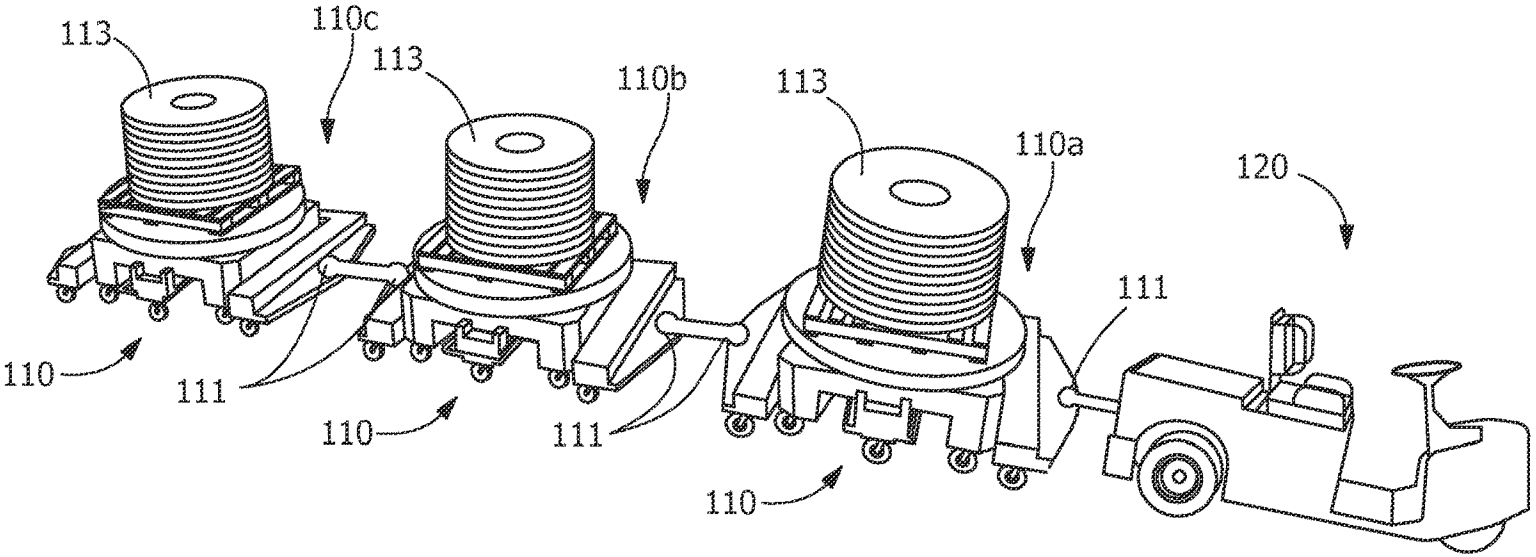
FIG. 1 is a perspective view of a mobile processing system including multiple mobile processing frames, according to an embodiment of the disclosure.
Figure 2:
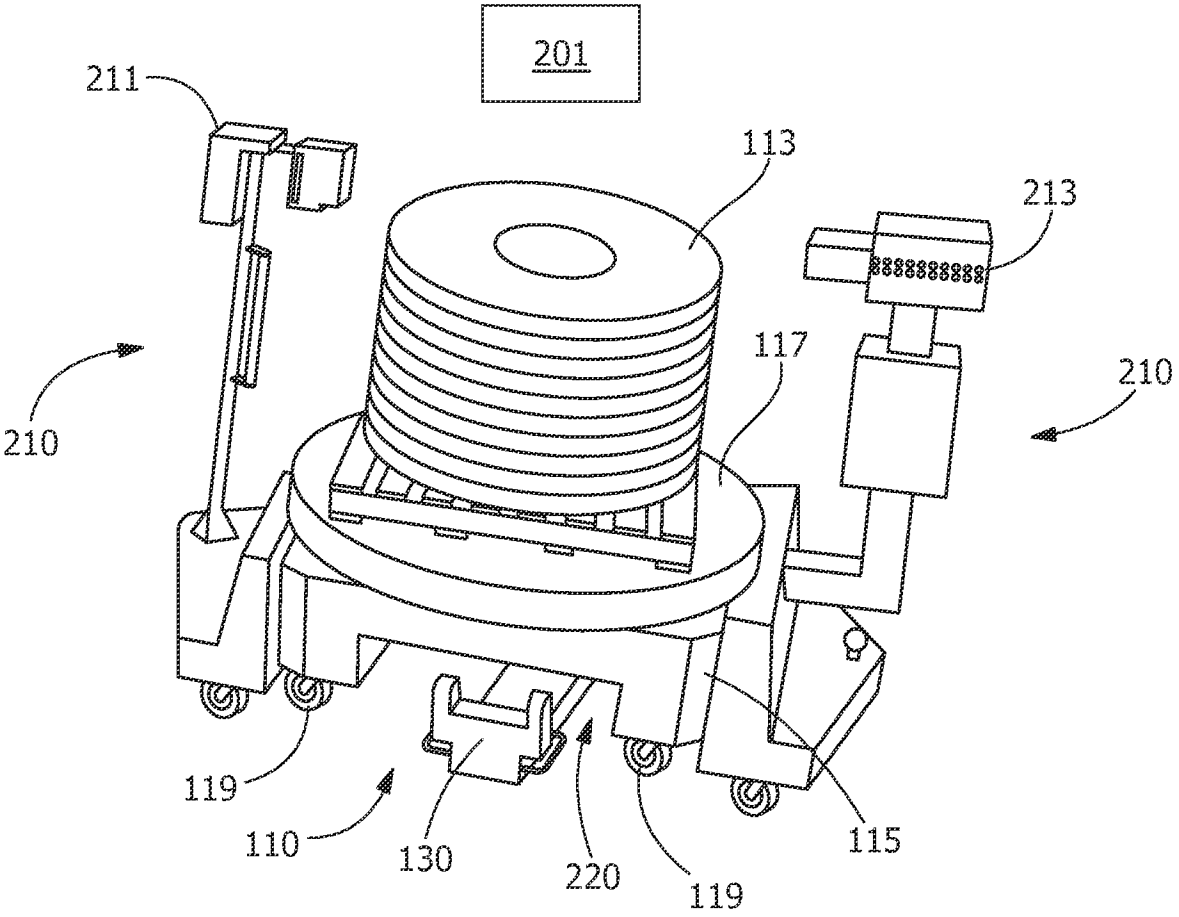
FIG. 2 is a perspective view of a mobile processing system in a locked position, according to an embodiment of the disclosure.
Figure 3:
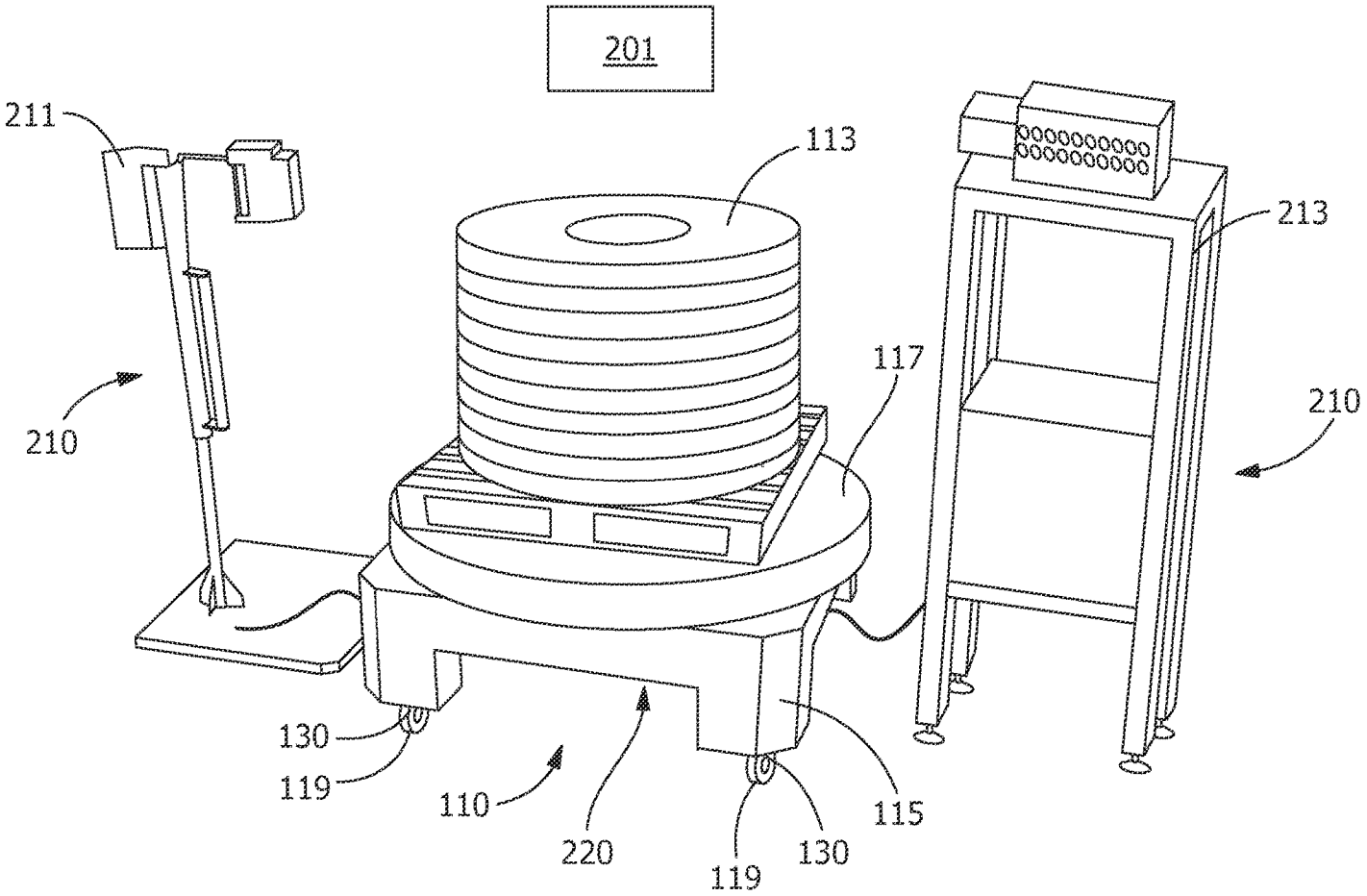
FIG. 3 is a perspective view of a mobile processing system including separate control devices, according to an embodiment of the disclosure.

Referring to FIGS. 1-3, a processing system 100 includes at least one processing frame 110, a transport device 120, and at least one control device 210 (see FIGS. 2-3). Each of the at least one processing frames 110 includes one or more coupling members 111 configured to detachably secure the processing frame 110 to another processing frame 110, the transport device 120, or a combination thereof. For example, as shown in FIG. 1, a first processing frame 110*a* is detachably secured to the transport device 120, a second processing frame 110*b* is secured to the first processing frame 110*a*, and a third processing frame 110*c* is secured to the second processing frame 110*b*. The coupling member 111 includes any suitable member for directly or indirectly securing the processing frame 110 to another device. Suitable coupling members include, but are not limited to, a latch, a fastener, a clasp, a ball and hitch, or a combination thereof. As will be appreciated by those skilled in the art, the example above is not intended to limit the scope of the disclosure, rather, the processing system 100 may include any suitable number of the processing frames 110 with any combination of coupling members 111.

In one embodiment, a processing material 113 is removably positioned on one or more of the processing frames 110. In another embodiment, the processing material 113 positioned on each of the at least one processing frames 110 is the same or substantially the same. Alternatively, the processing material 113 differs between one or more of the processing frames 110. Suitable processing materials 113 include any material configured to facilitate feeding from the processing frame 110 to a processing device 201 (see FIG. 2), such as a stamping press. For example, the processing material 113 may include spooled, rolled, and/or wound material that is fed through rotation of the processing frame 110 and/or a portion thereof. In a further embodiment, the processing material 113 is placed on a pallet or other article suitable for facilitating positioning and/or removal of the processing material from the processing frame 110.

The transport device 120 is configured to push, tow, or otherwise move the at least one processing frame 110 detachably secured thereto. The moving of the at least one processing frame 110 provides transportation of the processing material 113 positioned on one or more of the processing frames 110. By transporting the processing material 113 on the at least one processing frame 110, the processing system 100 provides movement of the processing material 113 between processing areas without removing the processing material 113 from the processing frame 110. The simultaneous movement of multiple processing materials 113 with a single transport device 120 and/or the movement of the processing material 113 without removal from the processing frame 110 reduces or eliminates the use of a forklift or other device to transport the processing material 113, decreases processing down time, increases processing efficiency, or a combination thereof.

Figure 5:
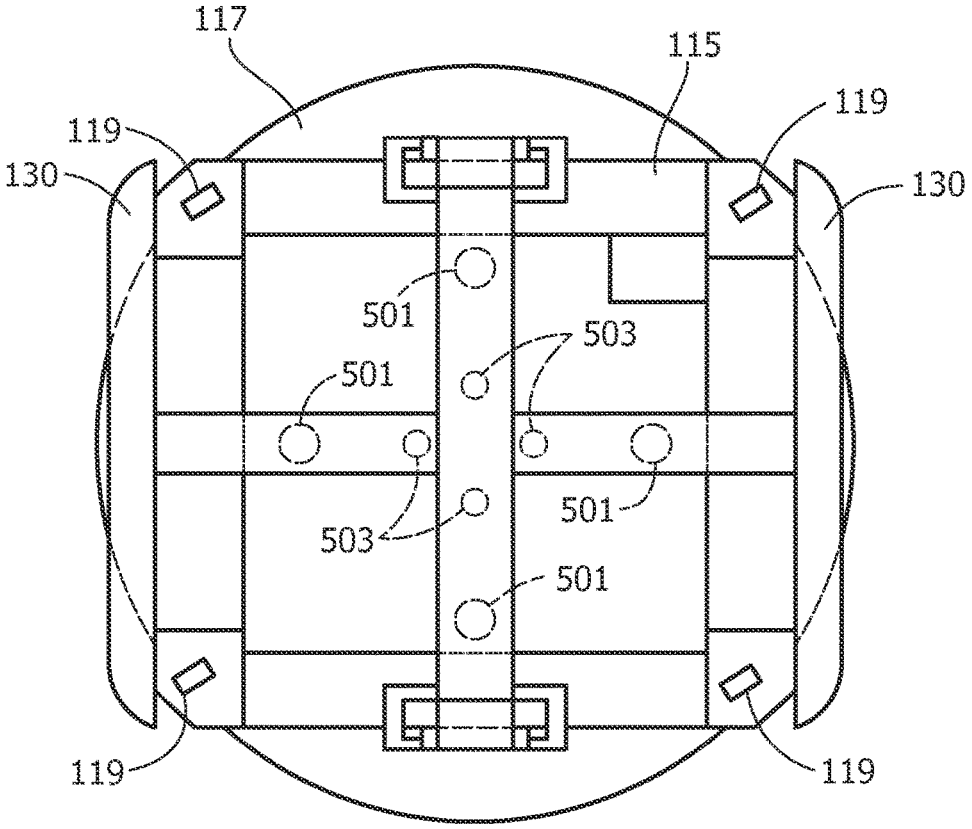
FIG. 5 is a bottom view of a mobile processing system, according to an embodiment of the disclosure.

As illustrated in FIGS. 2-3, each of the at least one processing frames 110 includes a base portion 115, a turntable 117 rotatably coupled to the base portion 115, a mobile support 119 opposite the turntable 117, and a locking member 130. As best shown in FIG. 5, a motor 220 is secured to the base portion 115 and operably connected to the turntable 117. The motor is configured to rotate the turntable 117 and the processing material 113 positioned thereon, facilitating feeding of the processing material 113 from the processing frame 110. The mobile support 119 includes any suitable support for facilitating movement of the base portion 115, such as, but not limited to, wheels, rollers, casters, or a combination thereof. The locking member 130 is configured to selectively restrict or eliminate movement of the processing frame 110 on the mobile support 119.

In one embodiment, the locking member 130 includes an article configured to extend from and retract towards the base portion 115. In a refracted position, as illustrated in FIG. 1, the locking member 130 permits movement of the processing frame 110 on the mobile support 119. In an extended position, as illustrated in FIG. 2, the locking member 130 engages a floor or other surface to restrict or eliminate movement of the processing frame 110. In another embodiment, the locking member 130 includes a mechanical lock, an air cylinder or other pneumatic device 501 (see FIG. 5), or a combination thereof. Connecting a pneumatic connector to the processing frame 110, such as through a receptacle 230 in the base portion 115, activates the pneumatic device 501. Activation of the pneumatic device 501 extends the locking member 130 from the base portion 115 to engage the floor, which restrict or eliminates movement of the processing frame 110. In a further embodiment, the locking member 130 includes a spring or other retracting device 503. The retracting device 503 is configured to retract the locking member 130 towards the base member 115 when the pneumatic device 501 is deactivated. Alternatively, as illustrated in FIG. 3, the locking member 130 includes wheel locks configured to selectively restrict or eliminate movement of the mobile support 119.

Once the processing frame 110 is positioned in the processing area, an electrical connector is coupled to the processing frame 110. The electrical connector provides power to the processing frame 110 and/or the at least one control device 210. In one embodiment, the electrical connector also provides communication between the base portion 115, the at least one control device 210, the motor 220, and/or an electrical control system. When in communication with the base portion 115, the at least one control device 210 monitors and/or controls rotation of the turntable 117, a feed rate of the processing material 113, and/or any other processing parameter. Suitable control devices include, but are not limited to, a dancer arm 211, a stock straightener 213, a sonar control device, a proximity device, other processing equipment, or a combination thereof.

The at least one control device 210 is integral with, detachably secured to, or separate from the base portion 115. For example, as illustrated in FIG. 2, the at least one control device 210 is integral with the locking member 130. The integral control device(s) 210 are electrically coupled with the receptacle 230, such that coupling the electrical connector to the receptacle 230 provides power to the integral control device(s) 210. Additionally, the integral control device(s) 210 are in wired or wireless communication with the base portion 115 and/or a separate control system. Alternatively, as shown in FIG. 3, the at least one control device 210 is separate from the base portion 115. Each of the separate control device(s) 210 is either fixed to or movable between the processing areas. In one embodiment, after positioning the processing frame 110 in the processing area, the separate control device(s) 210 are electrically coupled to the base portion 115. In another embodiment, electrically coupling the separate control device(s) 210 to the base portion 115 provides power to the control device(s) 210 and/or communication between the base portion 115 and the control device(s) 210. Alternatively, the separate control device(s) 210 are powered individually from and/or in wireless communication with the base portion 115.

Figure 4:
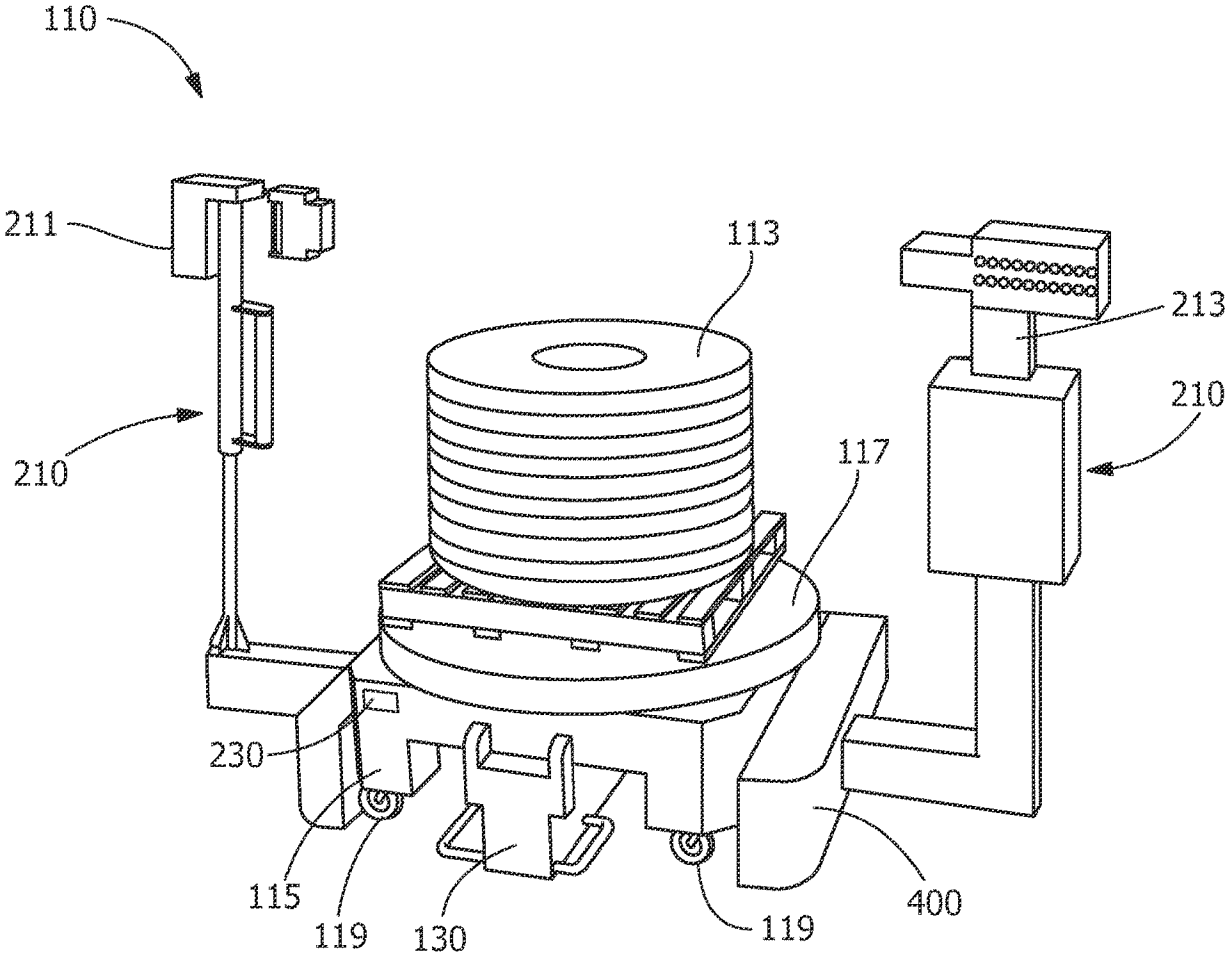
FIG. 4 is a perspective view of a mobile processing system in a docking station, according to an embodiment of the disclosure.

Referring to FIG. 4, in one embodiment, the processing system 100 includes a docking station 400 configured to receive the processing frame 110. In another embodiment, the docking station 400 secures the processing frame 110 and positions the processing material 113 relative to the processing device 201. In a further embodiment, the docking station 400 includes or facilitates electrical and/or pneumatic connection with the processing frame 110. The docking station 400 facilitates use of interchangeable processing frames 110 with the processing device 201. For example, to change processing materials 113, the processing frame 110 is removed from the docking station 400, and another processing frame 110 is positioned within the docking station 400. Changing the processing material 113 without removing the processing material 113 from the processing frame 110 reduces processing down time, reduces wear on the processing frames 110, and/or increases processing efficiency. Additionally, the at least one control device 210 may be fixed to the docking station 400, providing a single set of control devices 210 for a plurality of the processing frames 110. The single set of control devices 210 for a plurality of processing frames 110 reduces processing cost, decreases processing down time, increases processing efficiency, or a combination thereof.

Using the processing system 100 according to one or more of the embodiments disclosed herein, in one embodiment, a method of processing includes positioning the processing material 113 on one or more of the processing frames 110, moving the one or more processing frames 110 to a processing area, coupling the electrical and/or pneumatic connector to the processing frame 110, and feeding the processing material 113 to the processing device 201. Each of the processing frames 110 is coupled directly or indirectly to the transport device 120 either before or after positioning the processing material 113 thereon. Once the processing frame 110 is in the processing area, coupling the pneumatic connector to the processing frame 110 activates the locking member 130, restricting or eliminating movement of the processing frame 110. Additionally, coupling the electrical connector to the processing frame 110 provides power to the processing frame 110 and/or control over the one or more control devices 210. During the processing, one or more of the processing frames 110 are optionally coupled and/or decoupled to the electrical and/or pneumatic connectors to provide additional and/or differing processing material 113. After processing, detaching the pneumatic connector releases the locking member 130 permitting retraction of the locking member 130 and movement of the processing frame 110. The processing frame 110 may then be moved to another processing area, and/or a loading area for positioning of new processing material 113 thereon.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mobile processing system, comprising:

a frame including:

a base portion;

a turntable rotatably coupled to the base portion;

a motor positioned in and secured to the base portion and operably connected to the turntable;

a mobile support secured to the base portion, opposite the turntable;

a locking member attached to the base portion, the locking member movable from a retracted position, in which movement of the mobile support is permitted, to an extended position, in which movement of the mobile support is restricted;

a pneumatic device extending between the base portion and the locking member, the pneumatic device configured to move the locking member to the extended position;

a retracting device extending between the base portion and the locking member, the retracting device configured to move the locking member to the retracted position; and a docking station having a control device in communication with the base portion, the control device configured to monitor processing material positioned on the turntable and to control the motor in the base portion to control the rotation of the turntable; and a transport device configured to move the frame;

wherein with the frame positioned in the docking station, the pneumatic device is coupled to move the locking member to the extended position.

2. The mobile processing system of claim 1, wherein the control device is detachably secured to the base portion.

3. The mobile processing system of claim 2, wherein the frame is movable independent of the control device.

4. The mobile processing system of claim 2, wherein the control device is selected from the group consisting of a dancer arm, a stock straightener, and a combination thereof.

5. The mobile processing system of claim 1, further comprising a processing material positioned on the turntable.

6. The mobile processing system of claim 5, wherein the motor rotates the turntable, feeding the processing material to a processing device.

7. The mobile processing system of claim 6, wherein the control device is configured to control a feed rate of the processing material.

8. The mobile processing system of claim 1, wherein the frame is detachably coupled to the transport device.

9. The mobile processing system of claim 1, further comprising at least one additional frame.

10. The mobile processing system of claim 9, wherein the frame, each of the at least one additional frames, and the transport device are configured to detachably couple to each other.

11. A method of processing, comprising:

positioning a processing material on a turntable of a frame;

moving the frame to a processing area which includes a docking station, the frame including a locking member with a pneumatic device;

coupling a control device of the docking station to the frame, the control device being in wired or wireless communication with the frame;

activating the pneumatic device and moving the locking member to an extended position in which movement of the frame is restricted; and feeding the processing material from the frame to a processing device;

wherein the control device monitors the processing material positioned on the turntable and controls a rotation of the turntable and a feed rate of the processing material.

12. The method of claim 11, further comprising coupling the frame to a transport device, and operating the transport device to move the frame to the processing area.

13. The method of claim 11, further comprising providing at least one additional frame, and positioning additional processing material on the at least one additional frame.

* * * * *